US005798614A

United States Patent [19]

Bishop

[11] Patent Number: 5,798,614

[45] Date of Patent: Aug. 25, 1998

[54] FLUORESCENT LAMP FILAMENT DRIVE TECHNIQUE

[75] Inventor: Gary D. Bishop, Marion, Iowa

[73] Assignee: Rockwell International Corp., Costa Mesa, Calif.

[21] Appl. No.: 721,069

[22] Filed: Sep. 26, 1996

[51] Int. Cl.[6] ..... H05B 37/02

[52] U.S. Cl. ..... 315/107; 315/102; 315/106

[58] Field of Search ..... 315/105, 107, 315/106, 102, DIG. 7, 307, 224

[56] References Cited

U.S. PATENT DOCUMENTS 4,920,299 4/1990 Presz et al. ..... 315/105

*Primary Examiner*—Robert J. Pascal

*Assistant Examiner*—Michael Shingleton

*Attorney, Agent, or Firm*—Kyle Eppele; L. Keith Stephens; James P. O'Shaughnessy

[57] ABSTRACT

A method and apparatus for driving a fluorescent lamp is described wherein the fluorescent lamp is operated in the phanotronic, or hot-cathode, mode. The filament preheat current is decoupled from the arc current through synchronization of the filament voltage and arc voltage waveforms to provide sense windows during which the filament condition may be precisely and accurately determined. Sensing circuits provide correctional feedback to the filament voltage signal to provide optimal filament heating.

12 Claims, 3 Drawing Sheets

FLUORESCENT LAMP FILAMENT DRIVE TECHNIQUE

BACKGROUND OF THE INVENTION

The present invention generally relates to the field of fluorescent lamps, and more particularly to sensing and optimizing the condition of the filament of fluorescent lamps utilized for backlighting liquid crystal displays.

There are many applications in which it is desirable to be able to provide precise and stable control of the light produced by a fluorescent lamp. For example, in avionics applications, a fluorescent lamp may be utilized as the backlight for a display panel in an airplane cockpit for displaying system information. Thus, the operating characteristics of the fluorescent lamp should provide a stable light output over a wide dimming ratio. The life of the lamp should be maximized to avoid replacement or servicing.

The filaments of the fluorescent lamp are typically operated phanotronically in the hot cathode mode in which a preheat current is applied to the filaments of the fluorescent lamp. The preheat current is applied to the filament of a fluorescent lamp to vaporize the mercury and excite the argon gas within the lamp such to facilitate the flow of the arc current. The application of the arc current to the lamp causes the mercury vapor in the tube to emit ultraviolet radiation which strikes a phosphor coating disposed on the inner surface of the lamp, and the phosphor thereby emits visible light.

Strict control of the filament preheat current is necessary to ensure proper operation of the fluorescent lamp and to maximize the life of the filaments. If the filament preheat current is too low, the ions produced by the arc will collide with the cathode emissive material causing sputtering of the emissive material. If the filament preheat current is too high, emissive material will boil off the cathode. Both conditions result in a reduction in the life of the filaments. Thus, it is desirable to precisely monitor and control the filament preheat current in a fluorescent lamp utilized as a backlight for a display panel.

In addition, the application of the arc current to the filaments in driving the fluorescent tube may inadvertently add to or subtract from the total filament current by superposition resulting in localized overheating or underheating of the filaments. Thus, any efforts in monitoring and controlling the filament preheat current may be adversely affected by the arc current. It is therefore desirable to be able to decouple filament preheat current from the arc current to provide accurate monitoring of the filament condition such that filament preheat current may be appropriately adjusted.

SUMMARY OF THE INVENTION

Accordingly, is an object of the present invention to provide a technique for driving a fluorescent lamp which maximizes the life of the lamp.

It is another object of the invention to improve the operating characteristics of the fluorescent lamp.

It is a goal of this invention to provide a method and apparatus for decoupling the arc current from the filament preheat current in a fluorescent lamp in order to provide improved filament condition sensing.

Another goal is to provide a method and apparatus for sensing the condition of the filament without adverse influence by the arc current, and providing proper correction to the filament preheat current accordingly.

A further object of the present invention is to reduce and eliminate sputtering and premature filament wear in the fluorescent lamp due to underheating of the filament.

It is yet another object of the present invention to reduce and eliminate premature filament wear due to overheating of the filament.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE PREFERRED EMBODIMENT

Reference will now be made in detail to the presently preferred embodiment of the invention, an example of which is illustrated in the accompanying drawings.

Figure 1:
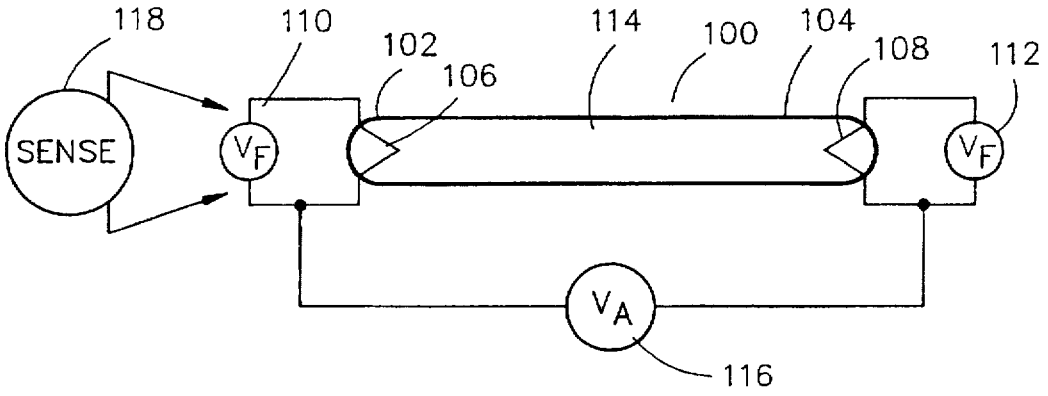
FIG 1 is a schematic diagram of a typical fluorescent lamp.

Referring more particularly to FIG. 1, there is shown a schematic diagram of a typical fluorescent lamp which may be utilized as the backlight of a liquid-crystal display panel or the like application where long lamp life is desired. The fluorescent lamp, generally designated 100, typically comprises an elongated glass tube in form having a first end 102 and a second end 104. The internal volume 114 of the lamp 100 may be evacuated and replaced with argon and mercury. Disposed in the lamp 100 at both ends (102 and 104) thereof are filaments (106 and 108). The filaments (106 and 108) are driven with filament voltage sources ("$V_F$") 110 and 112. The filament voltage sources (110 and 112) provide a preheat current to the filaments (106 and 108) to vaporize the mercury and excite the mercury vapor and argon gas mixture to a firing potential. An arc voltage source ("$V_A$") 116 applied across the lamp 100 filaments (110 and 112) provides an arc current through the mercury vapor such that the mercury vapor radiates ultraviolet light. The radiated ultraviolet radiation impinges upon a phosphor coating disposed upon the interior surface of the lamp 100 to produce visible light by fluorescence.

The condition of the filaments (106 and 108) may be sensed by a sensor ("SENSE") 118 applied thereto. Generally, the condition of the filaments (106 and 108) may be determined through sensing the filament temperature. The filament temperature may be determined, for example, by performing a reading of the filament impedance. The filament impedance changes with changes in the filament temperature; thus the temperature of the filaments (106 and 108) may be determined from the proportional relationship between filament impedance and filament temperature. The filament temperature may be maintained at a predetermined value by correcting the filament current passing through the filaments (106 and 108) through modulation of the output of filament voltage sources (110 and 112), e.g., amplitude, duty cycle, etc.

In practice, precise monitoring of the filaments (106 and 108) has been difficult to achieve. Maintaining the temperature of the filaments (106 and 108) at optimal operating conditions is essential to maximizing the life span of the lamp 100. When the filament preheat current is excessively low, the mercury vapor and argon gas mixture is not sufficiently ionized. Thus, the flow of electrons from the cathode filament 108 to the anode filament 106 creates a negative valued space charge in the interior 114 of the lamp. The negative valued space charge repels further electrons emitted from the cathode filament 108 which thereby collide with the cathode emissive material. Such a collision causes sputtering of the light and disintegration of the cathode filament 108. When the filament current is too high the temperature of the filaments reaches the point where emissive material boils off the filaments (106 and 108). Both the over current and under current condition result in premature failure of the fluorescent lamp 100. Additionally, variations in the arc current will add to or subtract from the filament current.

Figure 2:
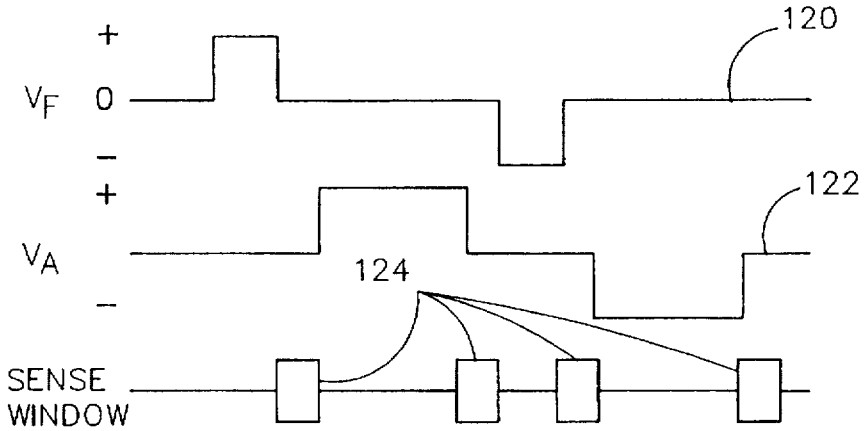
FIG. 2 is an illustration of typical waveforms applied to the fluorescent lamp of FIG. 1.

FIG. 2 illustrates the typical waveforms applied to the fluorescent lamp of FIG. 1. The waveform 120 of the filament voltage source $V_F$ is shown as being alternatively positive and negative valued such as the pulse waveform shown in FIG. 2. The waveform 122 of the arc voltage source $V_A$ is similarly shown as being alternatively positive and negative valued such as the pulse waveform shown in FIG. 2.

The voltage waveforms (120 and 122) result in corresponding current waveforms proportional to the filament impedance and effective lamp operating impedance respectively. The filament voltage $V_F$ applied to the filaments (106 and 108) may be modulated to obtain the desired filament preheat current and operating temperature. Similarly, the arc voltage $V_A$ may be modulated to obtain the desired lamp output, e.g., brightness. The filament voltage $V_F$ and the arc voltage $V_A$ therefore typically produce current waveforms which arbitrarily add through superposition resulting in difficulty in sensing and maintaining the proper optimal condition of the filaments (106 and 108).

The effects of the filament current and arc current may be decoupled by synchronization of the filament voltage $V_F$ and the arc voltage $V_A$. The filament voltage $V_F$ and the arc voltage $V_A$ are synchronized such that no portion of either waveform (120 and 122) overlaps the other. Thus, synchronization produces sense windows ("SENSE WINDOWS") 124 comprising durations of time during which both the filament voltage waveform 120 and the arc voltage waveform 122 are simultaneously zero valued as shown in FIG. 1. The filament condition may be sensed during an open sense window 124.

Figure 3:
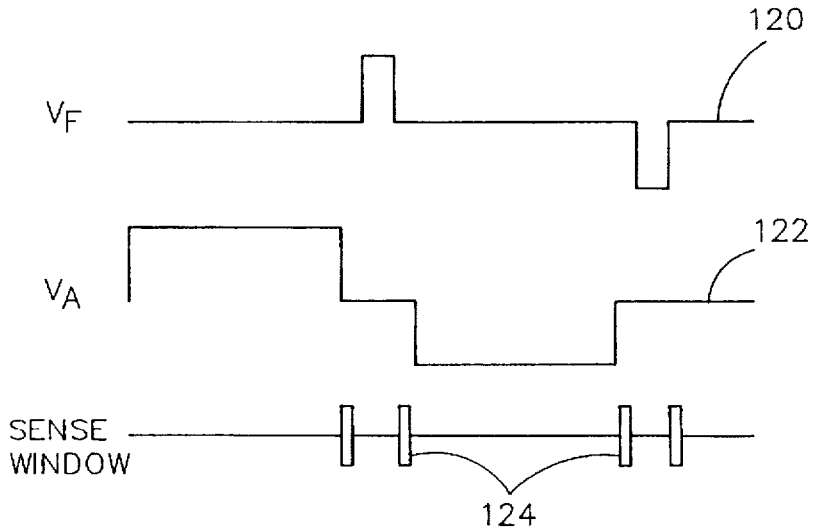
FIG. 3 is a further illustration of typical waveforms applied to the fluorescent lamp of FIG. 1.

FIG. 3 illustrates the relationship between the brightness of the fluorescent lamp 100 and the voltages applied thereto. The duty cycle of the arc voltage waveform 122 of FIG. 3 is increased in comparison with the arc voltage waveform 122 of FIG. 2 to produce greater light output form the lamp 100. Thus, as the brightness of the lamp 100 is increased, the contribution of arc current to filament heating increases. Similarly, as the brightness of the lamp 100 is decreased, the contribution of arc current to filament heating decreases. The filament condition is sensed during the sense window 124 such that the applied filament voltage $V_F$ may be accordingly corrected to maintain optimal filament temperature.

Figure 4:
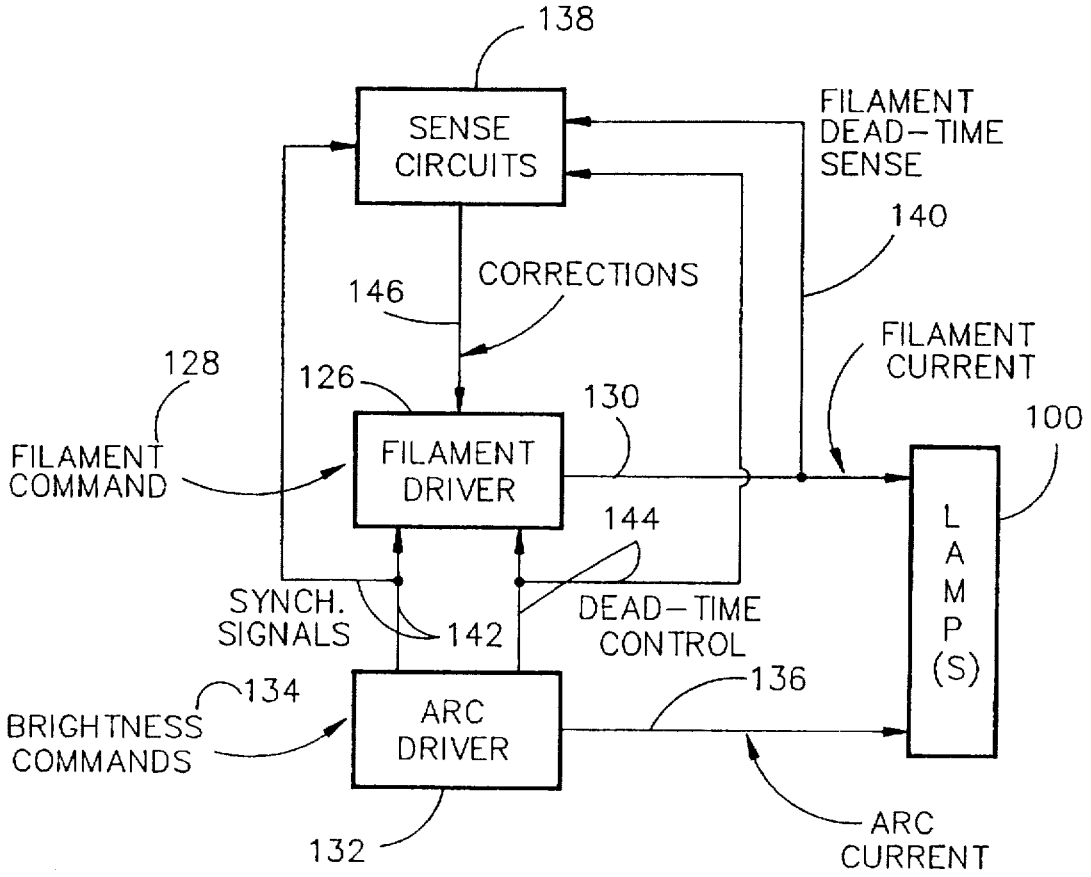
FIG. 4 is a schematic diagram of the apparatus utilized for driving a fluorescent lamp such as that shown in FIG. 1.

Now referring to FIG. 4, there is shown apparatus for driving a fluorescent lamp in accordance with the present invention. A filament driver ("FILAMENT DRIVER") 126 receives a filament command signal ("FILAMENT COMMAND") 128 such that a filament current ("FILAMENT CURRENT") 130 may be provided to the lamp 100 in response to the filament command 128. Similarly, an arc driver ("ARC DRIVER") 132 receives a brightness command signal ("BRIGHTNESS COMMANDS") 134 such that an arc current ("ARC CURRENT") 136 is provided to the lamp 100. Sense circuits ("SENSE CIRCUITS") 138 implement a means for sensing the condition of the filaments of the lamp 100 via filament sense line ("FILAMENT DEAD-TIME SENSE") 140 during the dead-time of the filament current 130. Synchronization signals ("SYNC. SIGNALS") 142 are sent from the arc driver 132 to the filament driver 126 and the sense circuits 138. Dead-time control signals ("DEAD-TIME CONTROL") 144 are sent from the arc driver 132 to the filament driver 126 and the sense circuits 138. The synchronization signals provide a common timing source such that the timing relationship between the arc current and the filament current may be maintained. The dead-time control signals maintain the duration of the sense windows such that the arc current and the filament current are simultaneously zero-valued for a predetermined duration. Thus, the arc current is ensured to be zero-valued for duration in which the filament current is also zero-valued.

The sense circuits 138 receive a synchronization signal 142 and a dead-time control signal 144 such that the condition of the filaments may be sensed during a sense window when the filament current and the arc current are simultaneously zero-valued. The effects of the filament current and the arc current are decoupled during the filament sensing process and do not adversely affect the sensing results. A correctional signal ("CORRECTIONS") 146 is sent to the filament driver 126 through a feedback arrangement to correct the filament current 130 in accordance with the sensed condition of the filaments. Thus, if the temperature of the filaments is detected to be above optimal operating temperature, a correctional signal may be sent to the filament driver to reduce the filament current accordingly. Conversely, if the temperature of the filaments is detected to be below optimal operating temperature, a correctional signal may be sent to the filament driver to increase the filament current accordingly.

Figure 5:
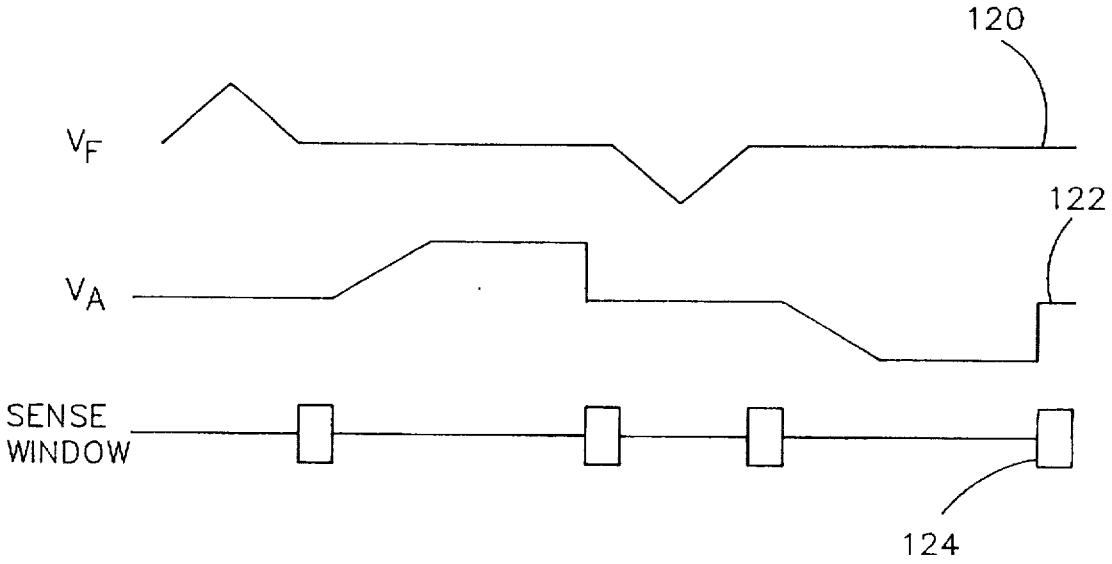
FIGS. 5, 6 and 7 are yet further illustrations of typical waveforms applied to the fluorescent lamp if FIG. 1.
Figure 6:
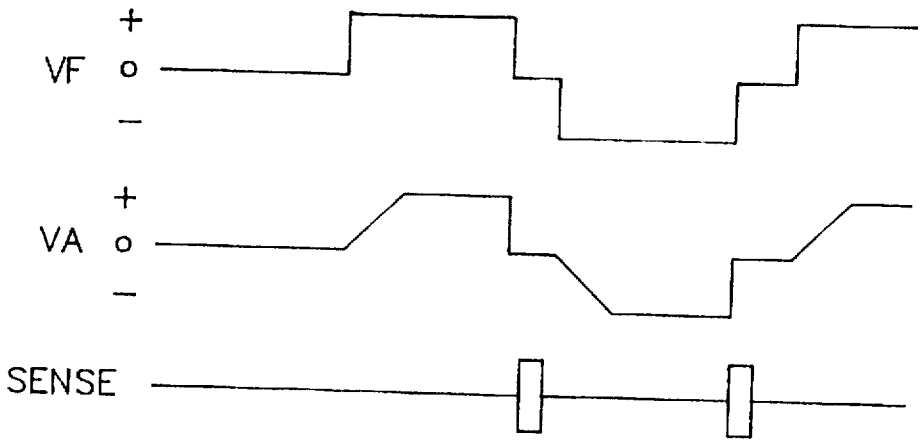
Figure 7:
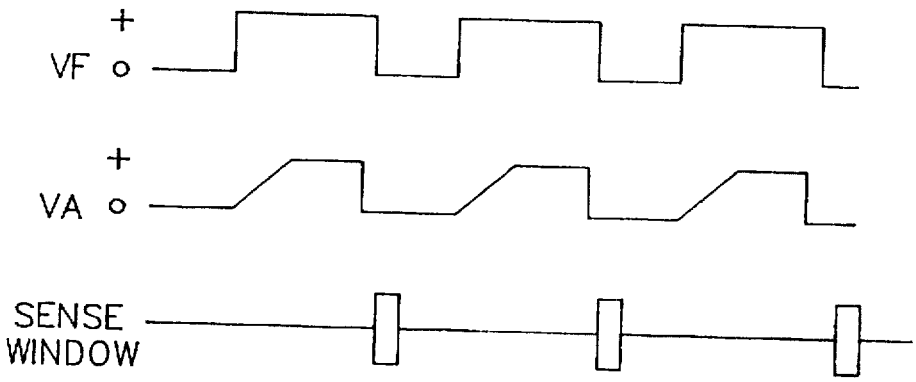

Referring now to FIGS. 5, 6 and 7, the waveforms applied to the fluorescent lamp of FIG. 1 are further illustrated. As can be seen from FIGS. 5, 6 and 7, the actual waveform of the filament voltage and the arc voltage may be arbitrarily defined. The filament and arc voltages merely need to be controlled with respect to duty cycle and dead-time (i.e. sense windows 124). The arc voltage waveform 122 may be an arbitrarily patterned waveform synchronized to the filament voltage waveform 120. Further, neither the arc voltage waveform 122 nor the filament voltage waveform 120 need be short term bipolar in form; rather any waveform providing sufficient duty cycle and sufficient average voltage level to ensure proper operation of the lamp 100 may be utilized.

It is believed that the fluorescent lamp filament drive technique of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An apparatus for driving a fluorescent lamp having a plurality of filaments, the apparatus comprising:

(a) a filament driver for providing a filament preheat current to the filaments of the fluorescent lamp;

(b) an arc driver for providing an arc current between the filaments of the fluorescent lamp;

(c) means for synchronizing said filament driver and said arc driver such that the a sense window condition is thereby produced, said sense window condition comprising a duration in which the filament preheat current and the arc current are simultaneously zero-valued;

(d) means coupled to said synchronizing means for sensing the condition of the filaments during said sense window condition wherein a correctional signal is sent to said filament driver in response the sensed condition of the filaments.

2. The apparatus of claim 1 wherein said sensing means senses the temperature of the filaments of the fluorescent lamp.

3. The apparatus of claim 2 wherein the correctional signal has the effect of reducing the filament preheat current upon said sensing means sensing the temperature of the filaments being greater than a first threshold value.

4. The apparatus of claim 2 wherein the correctional signal has the effect of increasing the filament preheat current upon said sensing means sensing the temperature of the filaments being below a second threshold value.

5. An apparatus for driving a fluorescent lamp having a plurality of filaments, the apparatus comprising:

(a) a filament driver receiving a filament command input, said filament driver providing a filament preheat current to the filaments of the fluorescent lamp in response to the filament command input;

(b) an arc driver receiving a brightness command input, said arc driver providing an arc current to the fluorescent lamp between the filaments of the fluorescent lamp in response to the brightness command input; and (b) means for sensing the condition of the filaments wherein said filament driver and said arc driver are synchronized to produce a duration during which the filament current and the arc current are simultaneously zero valued such that said sensing means senses the condition of the filaments during said duration, said sensing means providing a correctional signal to said filament driver in response thereto.

6. The apparatus of claim 5 wherein said sensing means senses the temperature of the filaments of the fluorescent lamp.

7. The apparatus of claim 6 wherein the correctional signal has the effect of reducing the filament preheat current upon said sensing means sensing the temperature of the filaments being greater than a first threshold value.

8. The apparatus of claim 6 wherein the correctional signal has the effect of increasing the filament preheat current upon said sensing means sensing the temperature of the filaments being below a second threshold value.

9. A method for driving a fluorescent lamp having a plurality of filaments comprising:

(a) providing a filament preheat current to the filaments;

(b) providing an arc current to the fluorescent lamp;

(c) decoupling the filament preheat current and the arc current by synchronizing the filament preheat current and the arc current such that a sense window is produced, said sense window being a duration during which the filament preheat current and the arc current are simultaneously zero-valued;

(d) sensing the condition of the filaments during a the sense window; and (e) correcting the filament preheat current according the sensed condition of the filaments.

10. The method according to claim 9 wherein said sensing step includes sensing the temperature of the filaments.

11. The method according to claim 10 wherein said correcting step comprises reducing the filament preheat current upon said sensing means sensing the temperature of the filaments being greater than a first threshold value.

12. The method according to claim 10 wherein said correcting step comprises increasing the filament preheat current upon said sensing means sensing the temperature of the filaments being below a second threshold value.

* * * * *